US009186009B2

(12) United States Patent
Laibe

(10) Patent No.: US 9,186,009 B2
(45) Date of Patent: Nov. 17, 2015

(54) HANGER STRAP AND SHOULDER COVERS

(71) Applicant: Erik Laibe, Torrance, CA (US)

(72) Inventor: Erik Laibe, Torrance, CA (US)

( * ) Notice: Subject to any disclaimer, the term of this patent is extended or adjusted under 35 U.S.C. 154(b) by 139 days.

(21) Appl. No.: 13/912,057

(22) Filed: Jun. 6, 2013

(65) Prior Publication Data

US 2014/0361053 A1 Dec. 11, 2014

(51) Int. Cl.

*A47G 25/44* (2006.01)
*A47G 25/18* (2006.01)
*A47G 25/14* (2006.01)

(52) U.S. Cl.

CPC ..... *A47G 25/442* (2013.01); *A47G 25/1442* (2013.01); *A47G 25/186* (2013.01)

(58) Field of Classification Search

CPC ... A47G 25/14; A47G 25/1442; A47G 25/18; A47G 25/183; A47G 25/186; A47G 25/48; A47G 25/44; A47G 25/441; A47G 25/442; A47F 7/19

USPC ..... 223/85, 88, 89, 94, 98; D06/315, 317, D06/318, 319

See application file for complete search history.

(56) References Cited

U.S. PATENT DOCUMENTS

| | | | | | |
|---|---|---|---|---|---|
| 395,884 | A * | 1/1889 | Donaldson | 223/94 |
| 2,372,458 | A * | 3/1945 | Tewell | 223/88 |
| 2,391,661 | A * | 12/1945 | Watkins et al. | 223/88 |
| 2,498,400 | A * | 2/1950 | Du Lude | 223/88 |
| 2,548,810 | A * | 4/1951 | Ozlek | 223/89 |
| 2,573,467 | A * | 10/1951 | Macaluso | 223/90 |
| 2,622,742 | A * | 12/1952 | Oldham | 211/113 |
| 2,652,958 | A * | 9/1953 | Alvord | 223/94 |
| 2,814,426 | A * | 11/1957 | Miller | 223/94 |
| 3,307,753 | A * | 3/1967 | Levine et al. | 223/95 |
| D234,243 | S * | 2/1975 | Lindemann | D6/328 |
| 4,632,287 | A * | 12/1986 | Bevelander | 223/98 |
| 5,029,739 | A * | 7/1991 | Blanchard et al. | 223/88 |
| 5,074,446 | A | 12/1991 | Suddath | |
| 5,718,362 | A * | 2/1998 | Silverman | 223/94 |
| 5,927,572 | A * | 7/1999 | Kiselik | 223/98 |
| 6,688,503 | B2 * | 2/2004 | Viazanko et al. | 223/89 |
| 6,964,360 | B2 | 11/2005 | Tubman | |
| 7,201,298 | B2 | 4/2007 | Miura | |
| 7,832,604 | B2 * | 11/2010 | Gouldson | 223/88 |
| 8,186,547 | B2 * | 5/2012 | Morawietz | 223/94 |
| 2005/0284899 | A1 * | 12/2005 | Fleming et al. | 223/85 |
| 2008/0087693 | A1 * | 4/2008 | Jones | 223/85 |
| 2008/0272159 | A1 * | 11/2008 | Robinson | 223/98 |

* cited by examiner

*Primary Examiner* — Ismael Izaguirre
(74) *Attorney, Agent, or Firm* — Jafari Law Group, Inc.

(57) ABSTRACT

The hanger strap and shoulder covers relates in general to a system for efficiently storing garments on a hanger while allowing for said garments to properly rest upon said hanger such that they do not form bumps, creases, or other wrinkles in general. This is accomplished by securely attaching wide shoulder covers to the shoulder rails of a typical wire, plastic, or other similar hanger. A hanger strap may thereafter be attached to the neck of the hanger. The lower portion of this hanger strap is designed to receive the hook portion of another hanger. This additional hanger may also have wide shoulder forms attached to it. This system may effectively double the space of a typical closet while ensuring that garments retain their proper form.

16 Claims, 10 Drawing Sheets

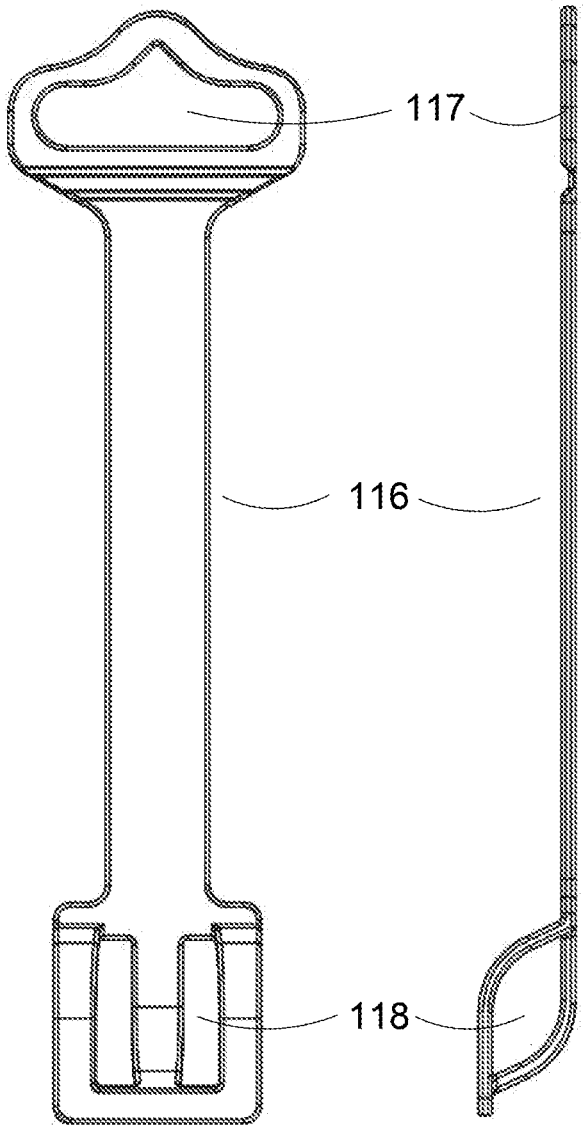
FIG. 10A FIG. 10B
FIG. 10C
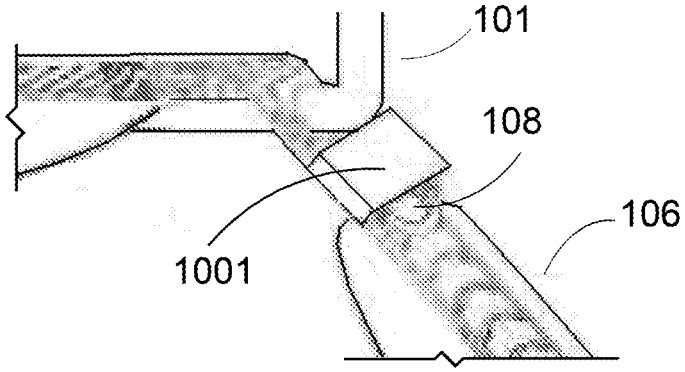

HANGER STRAP AND SHOULDER COVERS

TECHNICAL FIELD OF THE INVENTION

The hanger strap and shoulder covers relate in general to a hanger, and more specifically to covers that are attached to a hanger that may be used to adequately support clothing such that it retains its proper form. They may also be used to save space.

BACKGROUND OF THE INVENTION

A hanger is an excellent device for storing garments including shirts, pants, jackets, or any other type of garment made out of any particular material, be it natural or synthetic. If it can be worn, it can be hung. Hanging garments, however, presents a host of issues.

Generally, hangers have a tendency to cause bumps and creases in clothing, making it look unnatural or improperly cared for. For example, after washing and drying a particular garment such as a shirt, one may hang it on a typical plastic hanger. These hangers are relatively thin and provide very little support. Even if a shirt is perfectly placed upon such a hanger, after time, gravity pulls downward while the hanger stubbornly resists, leaving a perceptible aberration upon the shirt.

Various hangers have been developed to address these issues. Broad shouldered hangers, for example, provide much more support while eliminating the aberration problem. U.S. Pat. Nos. 7,201,298 and 6,964,360 are examples of such hangers. The problem with these types of hangers, however, is that they tend to be relatively expensive to manufacture, assemble, and ship. They may also be heavy. Other hanger forms such as U.S. Pat. No. 5,074,446 are generally formed into a given length and may only be efficiently used with garments of specific sizes. These captive design hangers lack adjustability.

A further limitation that is of particular note with broad shouldered hangers relates to the issue of efficiently using available closet space. These hangers require more horizontal space on the closet hanging rod, thus reducing the number of garments that may be hung. Moreover, in a poorly designed closet, one may be able to hang two dozen shirts in a row, but still be left with several inches of empty space below the shirts that cannot be realistically utilized.

Yet another limitation with all of the hangers described above is that more new hangers lead to more unnecessary waste. Perfectly good old hangers will likely be discarded to make room for the newly purchased hangers.

There is a need in the art for a hanger form that provides adequate support, that conserves valuable space, and that may be adapted to a wide variety of common hangers. It is to these ends that the hanger strap and shoulder covers have been developed.

BRIEF SUMMARY OF THE INVENTION

To minimize the limitations in the prior art, and to minimize other limitations that will be apparent upon reading and understanding the present specification, the hanger strap and shoulder covers describe a hanger accessory, comprising a first shoulder cover configured to extend longitudinally along an upper surface of a first shoulder rail of a hanger, and a second shoulder cover configured to extend longitudinally along an upper surface of a second shoulder rail of the hanger. The first shoulder cover is wider than the first shoulder rail of the hanger. The second shoulder cover is wider than the second shoulder rail of the hanger.

The hanger accessory further comprises a first fastener configured to securely attach the first shoulder cover to the hanger. The first fastener is configured to fasten the first shoulder cover to a hook of the hanger. The first fastener comprises a first portion attached to or integrated with the first shoulder cover, and a second portion comprising an opening configured to receive a hook therethrough, or a linear array of openings, wherein each of the openings is configured to selectively receive a hook therethrough for adjusting the position of the first shoulder cover with respect to the hook along the longitudinal axis of the first shoulder cover.

The hanger accessory further comprises a second fastener configured to securely attach the second shoulder cover to the hanger. The second fastener is configured to fasten the second shoulder cover to the hook of the hanger. The second fastener comprises a first portion attached to or integrated with the second shoulder cover, and a second portion comprising an opening configured to receive a hook therethrough, or a linear array of openings, wherein each of the openings is configured to selectively receive a hook therethrough for adjusting the position of the second shoulder cover with respect to the hook along the longitudinal axis of the second shoulder cover.

The hanger accessory further comprises a first clamp, a first clamp fastener configured to attach to the first clamp, a second clamp, and a second clamp fastener configured to attach to the second clamp, all to secure the first and second shoulder covers to the first and second shoulder rails.

The hanger accessory further comprises a first channel through which the first shoulder rail of the hanger extends, a second channel through which the second shoulder rail of the hanger extends, and a clip for holding the first and second fasteners together.

The hanger accessory further comprises a hanger support member including a first portion configured to attach to a hanger, and a second portion configured to support a second hanger wherein the first portion comprises an aperture configured to be placed around a hook of the hanger and thereafter rest at the base of the hook, and the second portion comprises an aperture configured to support the second hanger by receiving a hook of the second hanger. The hanger support member also comprises an elongated section situated between the first and second portions of the additional hanger support member.

It is an objective of the hanger strap and shoulder covers to provide adequate support to a garment. It is another objective of the hanger strap and shoulder covers to conserve space. It is yet another objective of the hanger strap and shoulder covers to be adaptable to a wide variety of common hangers.

These and other advantages and features of the hanger strap and shoulder covers are described herein with specificity so as to make the hanger strap and shoulder covers understandable to one of ordinary skill in the art.

BRIEF DESCRIPTION OF THE SEVERAL VIEWS OF THE DRAWINGS

Elements in the FIGS. have not necessarily been drawn to scale in order to enhance their clarity and improve understanding of these various elements and embodiments of the hanger strap and shoulder covers. Furthermore, elements that are known to be common and well understood to those in the industry are not depicted in order to provide a clear view of the various embodiments of the hanger strap and shoulder covers.

FIG. 10A is a front elevation view of a hanger strap.

FIG. 10B is a side elevation view of the hanger strap depicted in FIG. 10A.

FIG. 10C is a three dimensional view depicting a clip attached to the shoulder cover fasteners of the shoulder covers.

DETAILED DESCRIPTION OF THE INVENTION

In the following discussion that addresses a number of embodiments and applications of the hanger strap and shoulder covers, reference is made to the accompanying drawings that form a part thereof, where depictions are made, by way of illustration, of specific embodiments in which the hanger strap and shoulder covers may be practiced. It is to be understood that other embodiments may be utilized and changes may be made without departing from the scope of the hanger strap and shoulder covers.

Figure 1:
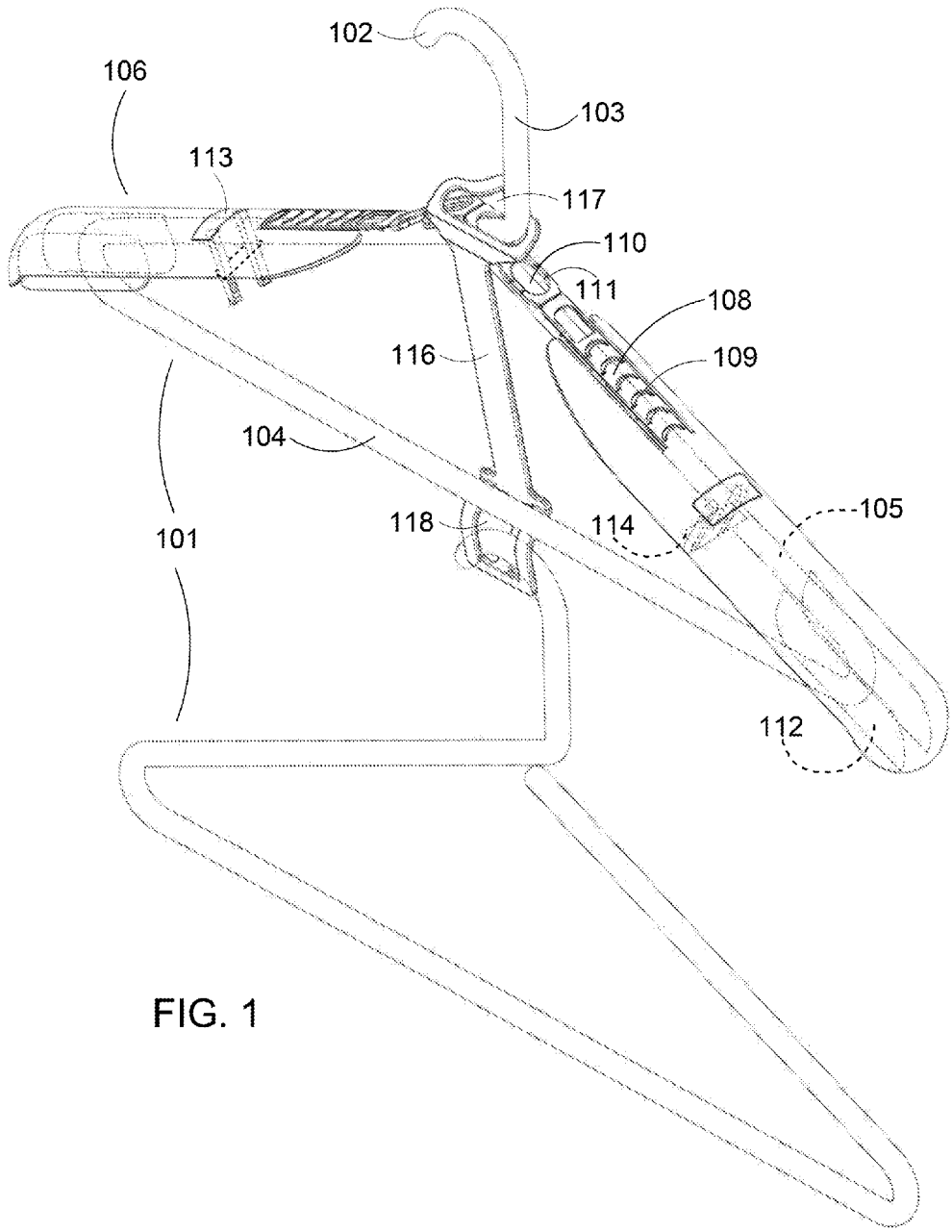
FIG. 1 is a three dimensional cross section view primarily depicting a hanger equipped with two shoulder covers and a hanger strap holding another hanger.

FIG. 1 is a three dimensional cross section view primarily depicting hanger 101 equipped with two shoulder covers 106 and hanger support strap 116. Hanger 101, however, is not to limit the wide array of other hangers that may be amenable to shoulder covers 106 and hanger support strap 116. Other hangers may include wire hangers, various forms of plastic hangers, wood hangers, or other synthetically or naturally made hangers, or any hybrid of materials used in the creation of any such hangers. Shoulder covers 106 and hanger support strap 116 may also be employed on hangers that have yet to be designed. The designs of hanger support strap 116 and shoulder covers 106 are what allow for them to be adapted to such a wide array of hanger styles.

Shoulder cover 106 has two features including shoulder cover fastener 108, and stability channel 112 that may be fluidly connected during the manufacturing process of shoulder cover 106. Shoulder cover 106 may be comprised of a plastic, plastic like material, or other compound.

Shoulder cover 106, when viewed from above, may be substantially wider than hanger 101 upon which it rests. Shoulder cover 106 may generally be arced in shape such that a line drawn from the center of one long edge of shoulder cover 106 to the center of the other long edge would be curved if viewed from a side elevation. Such curvature may allow for a garment to naturally rest upon shoulder cover 106 such that it does not crease, bend, or take on an unnatural shape. The proximal end of shoulder cover 106 may have a similar curvature and purpose as described above.

Shoulder cover fastener 108 may be fluidly connected near the distal end of shoulder cover 106 and extend beyond the distal end of shoulder cover 106. Shoulder cover fastener 108 may be positioned such that it would rest directly above hanger 101 when shoulder cover 106 is attached to hanger 101. From the proximal end of shoulder cover fastener 108 to its distal end may be a series of arced voids 109, openings 110, and opening grooves 111. Arced voids 109, openings 110, and opening grooves 111, may give flexibility to the shoulder cover fastener 108 allowing for shoulder cover 106 to be adapted to a wide array of hangers that may have dramatically different shaped shoulder rails. Opening grooves 111 in particular may help to add flexibility as they provide a joint like function and may be located perpendicularly across from one another on any particular opening 110.

Openings 110 may be of wide nature, such that they allow for hook 102 of hanger 101 to be easily guided through any particular opening 110. Moreover, shoulder cover fastener 108 may be comprised of several openings 110 that may be aligned single file, extending from near the center of shoulder cover fastener 108 to the distal end of shoulder cover fastener 108. Such an array of openings may give the entirety of shoulder cover 106 its adjustable nature. For example, if there were to be three openings aligned in a row from the distal end of the shoulder cover fastener extending toward the proximal end of said shoulder cover fastener, placing the hook of a hanger through the opening on the extreme distal end of the shoulder cover fastener would allow the shoulder cover to extend to its greatest length. It would thereby be amenable to a larger shaped hanger and ultimately a larger garment. By contrast, if the hook of a hanger were placed in the opening closest to the proximal end of the shoulder cover fastener, this would only allow the shoulder cover to extend to a lesser distance. But this may be desirable for a hanger of smaller dimensions for a smaller garment. In either scenario, the opening may provide a level of stability such that the shoulder cover may stay positioned upon the hanger.

Another feature of shoulder cover 106 that gives further overall stability is stability channel 112. In FIG. 1, stability channel 112 is represented by the dotted lines found underneath the proximal end of shoulder cover 106. Stability channel 112 may be fluidly connected to shoulder cover 106 during the manufacturing process. Stability channel 112 may be comprised generally of two walls that may be situated beneath and near the proximal end of shoulder cover 106 and extend in a direction toward the distal end of shoulder cover 106. These walls may be aligned in a parallel fashion and have such a distance between the two as to accommodate hanger 101, or any other typical hanger as described above.

Another measure of stability that may be used to secure shoulder cover 106 to hanger 101 is clamp 113 and clamp fastener 114. Clamp 113 may be manually connected to shoulder cover 106 and hanger 101 through a hole or series of holes in shoulder cover 106. As depicted in FIG. 1, these holes are between stability channel 112 and shoulder cover fastener 108. However, they may be situated elsewhere, such as near the proximal end of a shoulder cover. In such an embodiment, the stability channel may be positioned nearer to the distal end of the shoulder cover to allow for the clamp and clamp fastener to be effectively utilized in this alternate position.

Wherever these holes are situated, they may be of such a nature that they are able to house clamp 113 such that clamp 113 may not slip through shoulder cover 106, but allow for the posts of clamp 113 to rest on the underside of shoulder cover 106. For example, the two posts of clamp 113 may be guided through the two preexisting holes in shoulder cover 106 as depicted in FIG. 1.

Clamp 113 may generally consist of the same material as shoulder cover 106 as described above. Clamp 113 may also generally consist of a base and two posts situated parallel to one another and fluidly connected to said base in the manufacturing process. Said posts may be of such a length that when inserted into shoulder cover 106 they extend slightly beyond the plane of the arced edges of shoulder cover 106. However, this length may be adjusted more or less depending upon the shape of hanger 101 to which clamp 113 may be attached.

To further effectuate the function of clamp 113, clamp fastener 114 may be manually connected and secured to clamp 113. Clamp fastener 114 may be generally constructed of the same material as shoulder cover 106 as described above. Clamp fastener 114 may also be constructed so that it is compatible with clamp 113. Clamp 113 and clamp fastener 114 may be generally regarded as a male/female pair. As such, clamp fastener 114 may have two holes situated at such a distance as to allow the dual posts of clamp 113 to be inserted with relative ease.

Moreover, clamp fastener 114 may be of a dual nature. Clamp fastener 114 may generally consist of two parts including a base with two holes and an extension that may be fluidly connected during the manufacturing process. Said extension may be situated between said holes, and may have an indent on the distal end to allow for accommodation of a thin hanger. For example, a shoulder cover placed on a wire hanger would be amenable to the distal portion of the extension where the indent may be found and substantially house the wire hanger.

In another embodiment, such as depicted in FIG. 1 where a substantially larger hanger 101 is portrayed, clamp fastener 114 may be attached to the dual posts of clamp 113 such that its extension is facing away from shoulder rail 105 and the smooth portion of clamp fastener 114 is tightly secured to shoulder rail 105.

Once the requisite number of shoulder covers 106 has been appropriately attached to hanger 101, hanger support strap 116 may also be attached to hanger 101. However, hanger support strap 116 may be attached to hanger 101 before or after any shoulder cover 106 has been attached to hanger 101. Hanger support strap 116 may generally be comprised of the same material as shoulder covers 106 as described above.

Hanger support strap 116 may have two functional features at either end to effectuate its purpose. The proximal end of hanger support strap 116 may contain first aperture 117. First aperture 117 may be used to attach hanger support strap 116 to hanger 101 such that first aperture 117 hangs around the base of neck 103 of said hanger 101. The distal end of hanger support strap 116 may contain second aperture 118. This second aperture 118 may be formed as depicted in FIG. 1 by three tonglike features. The outer tongs may be formed such that they extend outward and then curve downward while the middle tong extends outward in the opposite direction and then curves downward to meet the outer tongs on a horizontal plane which may connect the three tongs. The curved nature of said tongs create second aperture 118 and may allow for hook 102 of another hanger 101 to be inserted. When an additional hanger 101 is inserted, this may allow for additional space to be utilized. In another embodiment, the second aperture may be in the shape of an enclosed hook, which would serve the same purpose of allowing a hook to securely rest within the second aperture. Furthermore, the second aperture may not be an aperture at all, but in the shape of an open hook while still serving the same purpose.

Figure 2A:
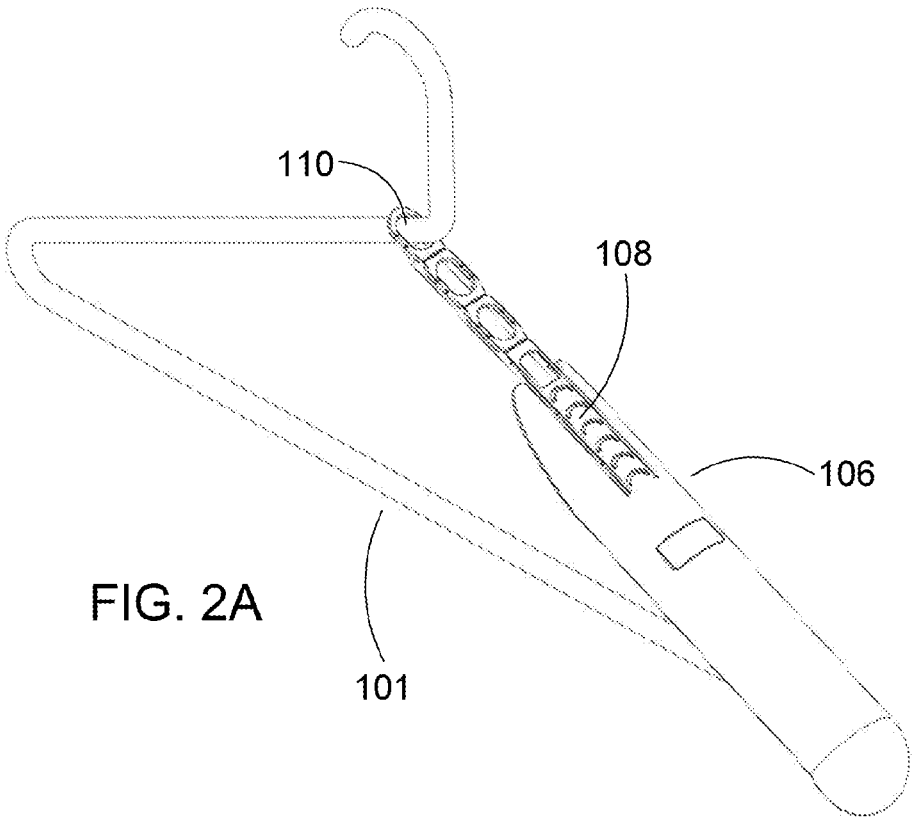
FIG. 2A is a three dimensional view depicting a hanger equipped with a shoulder cover.
Figure 2B:
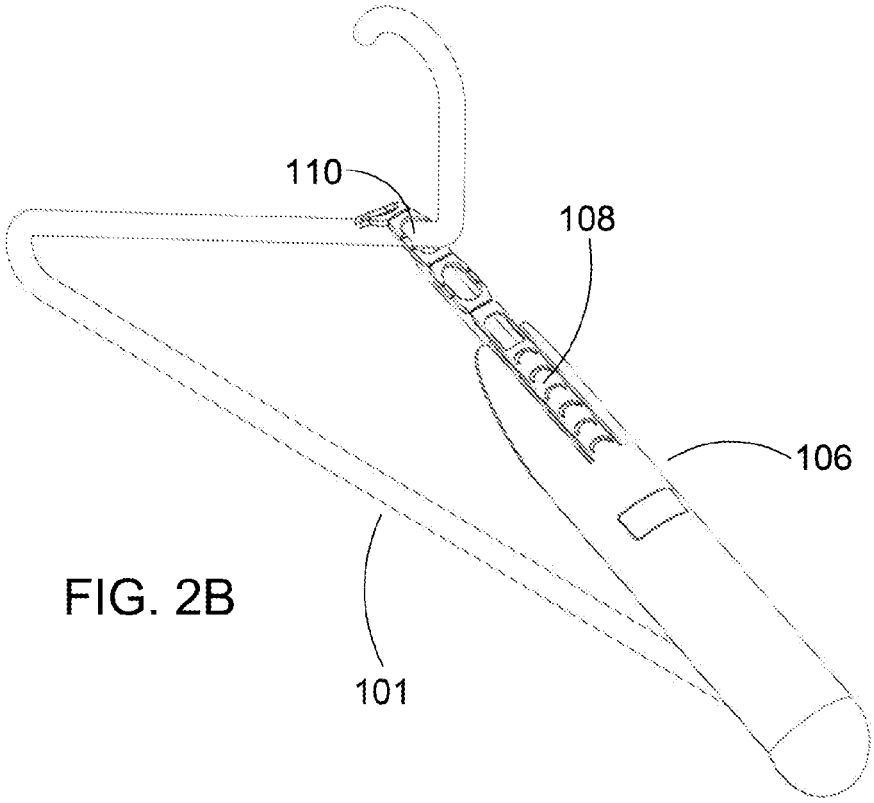
FIG. 2B is a three dimensional view depicting a hanger equipped with a shoulder cover in a modified position from that of FIG. 2A.

FIG. 2A is a three dimensional view depicting an embodiment comprising hanger 101 equipped with one shoulder cover 106. This embodiment, combined with FIG. 2B, depicts the adjustable nature of shoulder cover 106. In FIG. 2A, shoulder cover 106 is attached to hanger 101 via the last opening 110 on the most distal end of shoulder cover fastener 108. This may allow for shoulder cover 106 to be fully extended to accommodate, for example, a garment of wide breadth.

In FIG. 2B, shoulder cover 106 is attached to hanger 101 via the penultimate opening 110 on the most distal end of shoulder cover fastener 108. This may allow for shoulder cover 106 to be extended to a lesser degree to accommodate, for example, a garment of a smaller breadth. The embodiments depicted in FIGS. 2A and 2B, however, are not to be limiting. A shoulder cover may be attached to a hanger via any opening to accommodate a concomitantly sized garment. Furthermore, additional openings may be fluidly connected during the manufacturing process, and/or the shoulder cover fastener may be lengthened or shortened to accommodate a wide array of garments.

Figure 3:
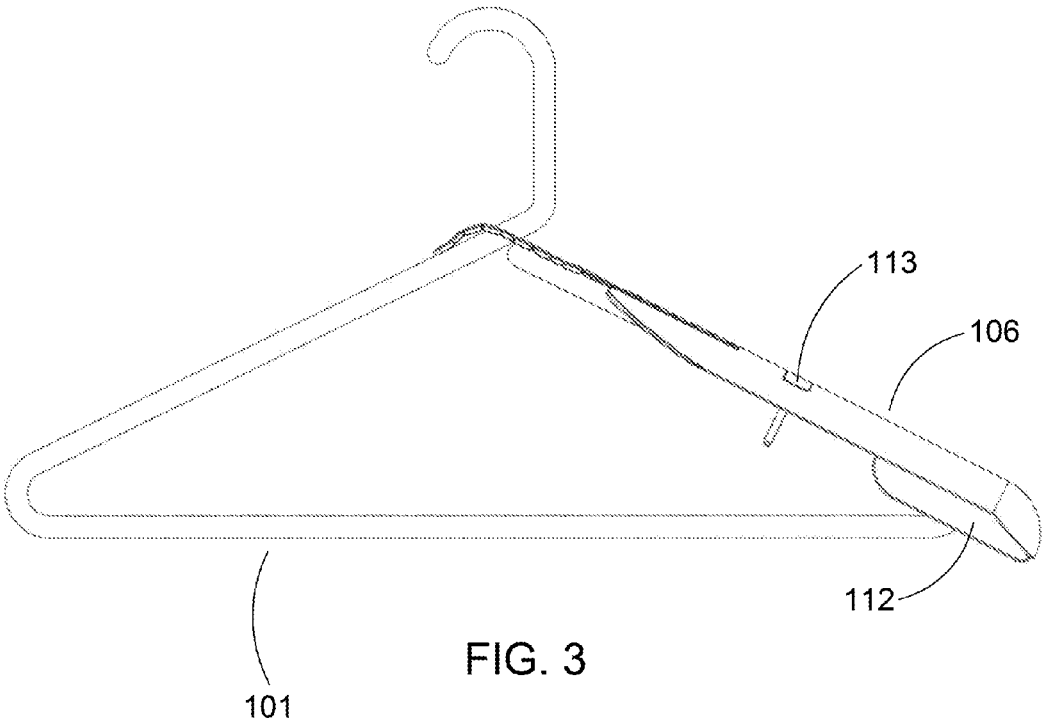
FIG. 3 is a front elevation view of an embodiment depicting a hanger, stability channel, and a clamp.

FIG. 3 is a front elevation view of an embodiment depicting primarily hanger 101 and the various components of shoulder cover 106. Stability channel 112 is fluidly connected underneath shoulder cover 106 and is partly visible. Also depicted is one post of clamp 113, which may be manually inserted to shoulder cover 106. This embodiment, however, should not be construed as limiting in scope. As discussed above, the various components of shoulder cover 106 may be larger, smaller, and/or placed in varying locations along the entirety of shoulder cover 106.

Figure 4A:
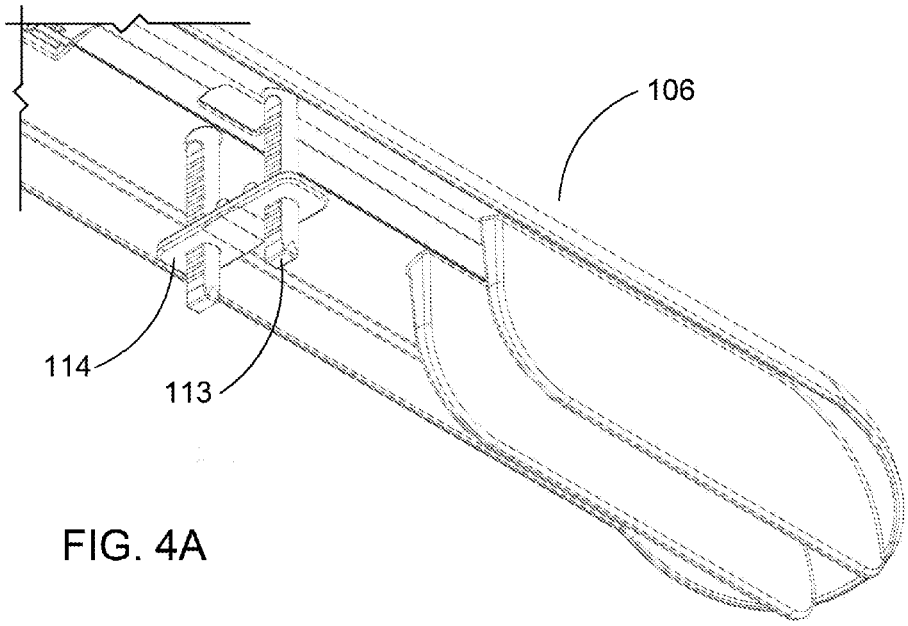
FIG. 4A is a three dimensional view depicting in further detail the components situated on the underside of the shoulder cover without a hanger.

FIG. 4A is a three dimensional view depicting in further detail the components situated on the underside of shoulder cover 106. In this embodiment, shoulder cover 106 has two holes through which the ribbed posts of clamp 113 may penetrate. As noted above, clamp 113 may be composed of primarily three components fluidly connected during the manufacturing process, including a back and two ribbed posts. The back of clamp 113 may thus rest upon the structure of shoulder cover 106, allowing for the ribbed posts to extend downward through said holes.

Once the posts of clamp 113 have been properly inserted, clamp fastener 114 may be attached. Clamp fastener 114 may be pressed upon the ribbed posts of clamp 113. The holes of clamp fastener 114 may be of such a diameter that one must apply a certain amount of pressure in order for clamp fastener 114 to be securely attached to clamp 113.

Once attached, clamp fastener 114 may be detached, for example, to remove shoulder cover 106 in order to apply it to another hanger. Clamp fastener 114 may also be detached and reversed, such that its extension (discussed above) is able to securely attach to, for example, a wire hanger. FIG. 4A depicts clamp fastener 114 with its attachment facing the underside of shoulder cover 106. However, no hanger is depicted.

Figure 4B:
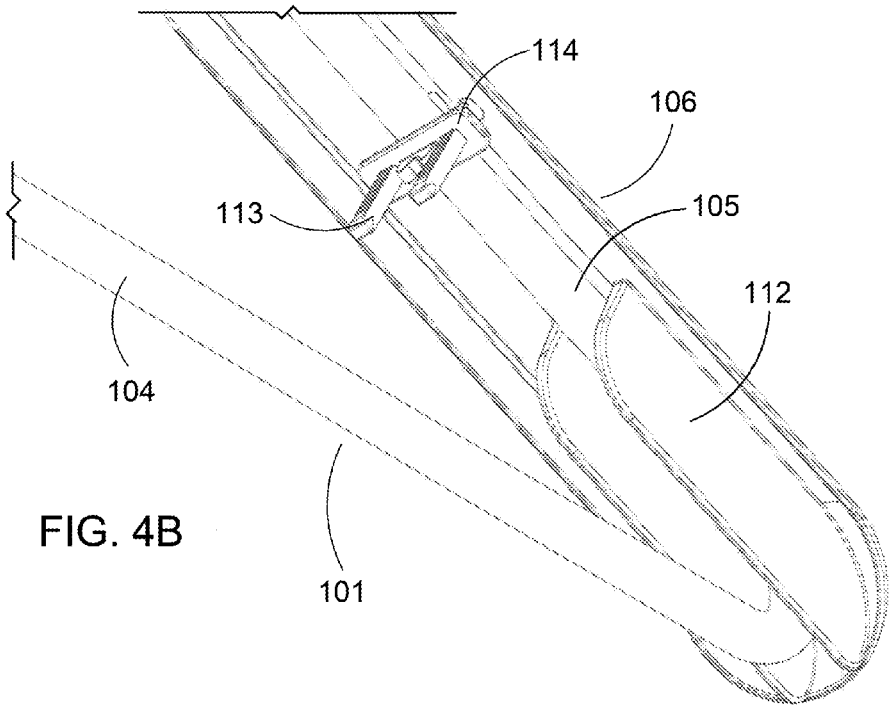
FIG. 4B is a three dimensional view depicting in further detail the components situated on the underside of the shoulder cover with a hanger.

FIG. 4B is a similar depiction to FIG. 4A, but with hanger 101 depicted. Because hanger 101 is of a wide nature, clamp fastener 114 may face toward the direction of horizontal rail 104 after being connected to clamp 113. In another embodiment, however, clamp fastener 114 may face the other direction, even with hanger 101 which is of a wide nature. FIG. 4B also depicts how both clamp 113 and clamp fastener 114 work in tandem with stability channel 112 to secure shoulder cover 106 to shoulder rail 105 of hanger 101.

Figure 5A:
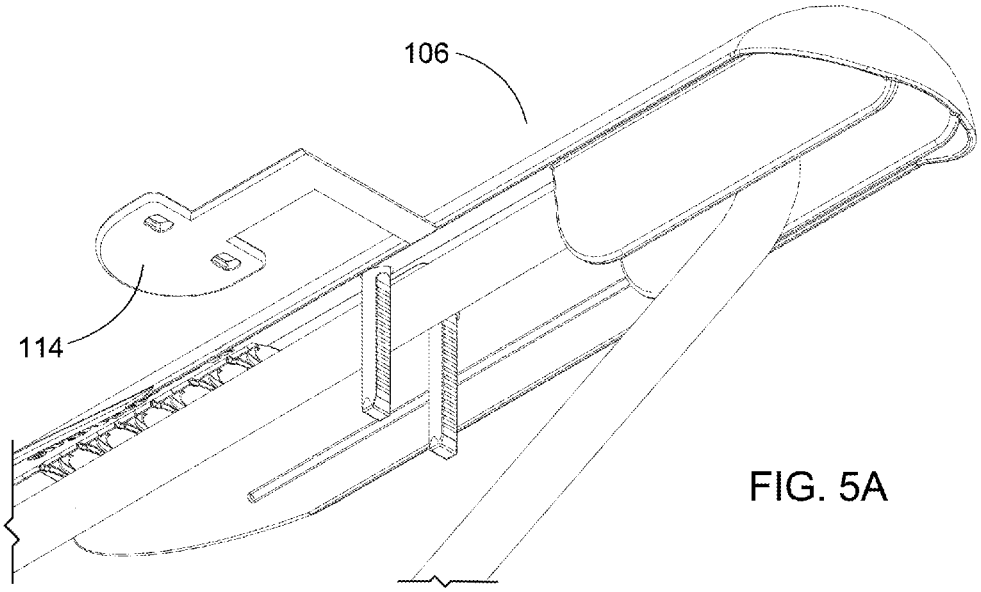
FIG. 5A is a three dimensional view depicting an alternative embodiment of a clamp fastener attached to a shoulder cover in an open position.
Figure 5B:
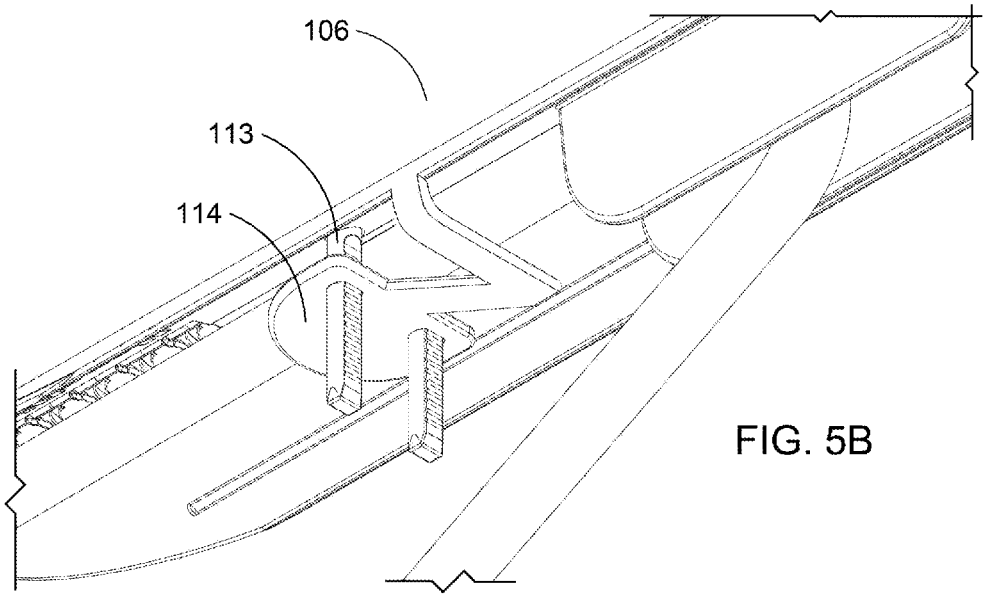
FIG. 5B is a three dimensional view depicting an alternative embodiment of a clamp fastener attached to a shoulder cover and secured to a clamp.

FIG. 5A is a three dimensional view depicting an alternative embodiment of clamp fastener 114 attached to shoulder cover 106 in an open position. FIG. 5B is a three dimensional view depicting an alternative embodiment of clamp fastener 114 attached to shoulder cover 106 and secured to clamp 113. In both FIGS. 5A and 5B clamp fastener 114 may be fluidly connected to shoulder cover 106 during the manufacturing process and be made of a material that is flexible. As such, the chances of losing clamp fastener 114 may be diminished.

Figure 6A:
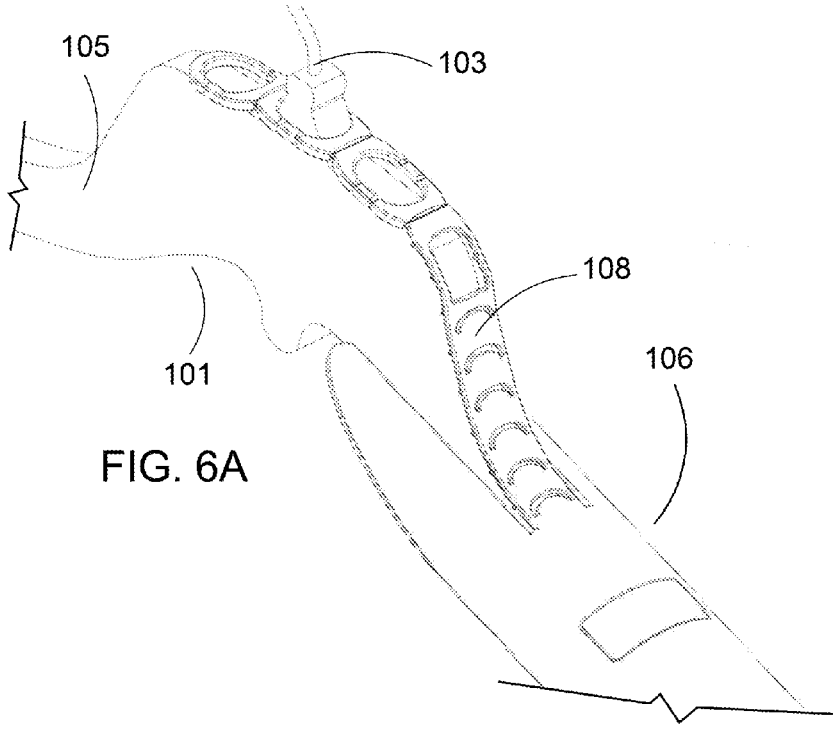
FIG. 6A depicts an alternative embodiment of a shoulder cover attached to a differently shaped hanger.

FIG. 6A depicts an alternative embodiment with shoulder cover 106 attached to a differently shaped hanger 101. In this embodiment, hanger 101 is mainly comprised of neck 103 and two shoulder rails 105. FIG. 6A also depicts how shoulder cover 106 is adaptable to a differently shaped shoulder rail 105. Shoulder cover fastener 108 may be directed upwards to an unspecified degree from the main body of shoulder cover 106 such that it is able to securely attach around neck 103 yet still provide support for a garment that may straddle shoulder cover 106.

Figure 6B:
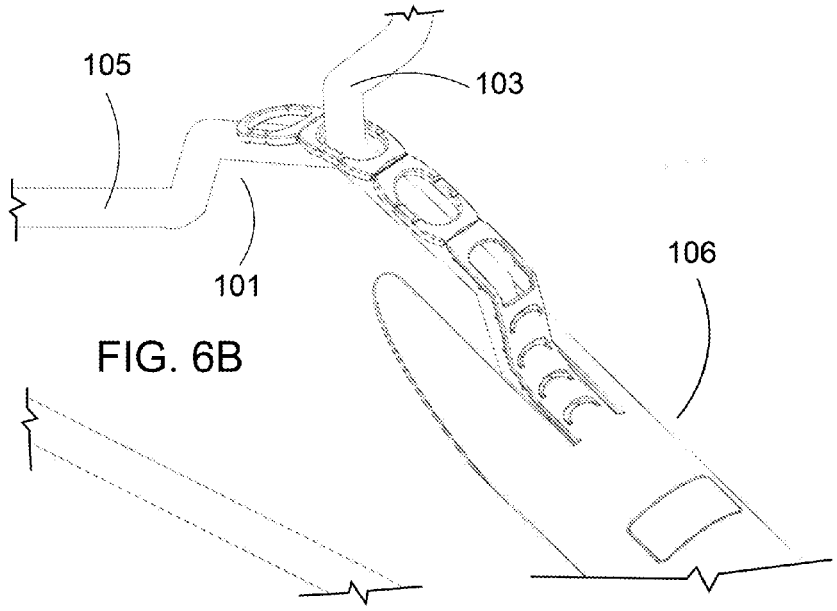
FIG. 6B depicts an alternative embodiment of a shoulder cover attached to another differently shaped hanger.

FIG. 6B depicts an alternative embodiment of shoulder cover 106 attached to yet another differently shaped hanger 101. Similar to FIG. 6A, shoulder rail 105 is uniquely and yet abruptly angled near neck 103, but shoulder cover 106 may still be adapted even to this unique design.

Figure 7:
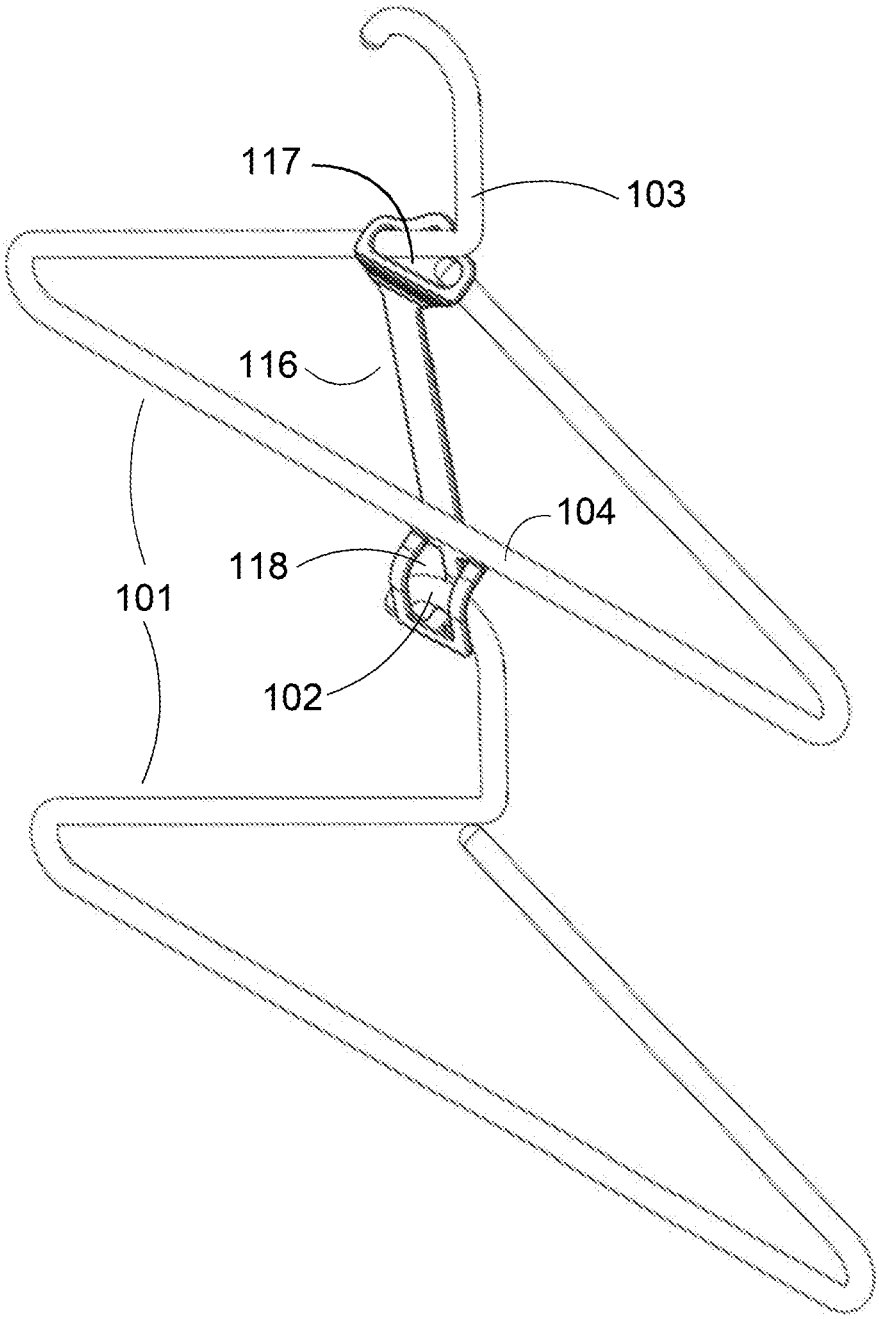
FIG. 7 is a three dimensional view depicting a hanger strap employed by two hangers.

FIG. 7 is a three dimensional view depicting hanger support strap 116 employed by two hangers 101. For ease of reference, no shoulder covers 106 are depicted, however this should not be construed as limiting in scope, as hanger support strap 116 and shoulder covers 106 may be used in tandem with one another. In the embodiment depicted, first aperture 117 is placed around neck 103 of hanger 101. Hanger support strap 116 is then positioned such that it falls behind horizontal rail 104 of said hanger 101, and the top of the second aperture 118 rests near the back side of horizontal rail 104. In another embodiment, however, the second aperture may rest on the front side of the horizontal rail. In either scenario, hook 102 of a second hanger 101 may be positioned such that it securely rests within the confines of second aperture 118. As noted above, said second hanger 101 may or may not be equipped with shoulder covers. In other embodiments, differently sized and shaped hangers may also be employed, including a first hanger that is different from a second hanger. The hanger support strap may also be lengthened or shortened to accommodate hangers of varying proportions.

Figure 8:
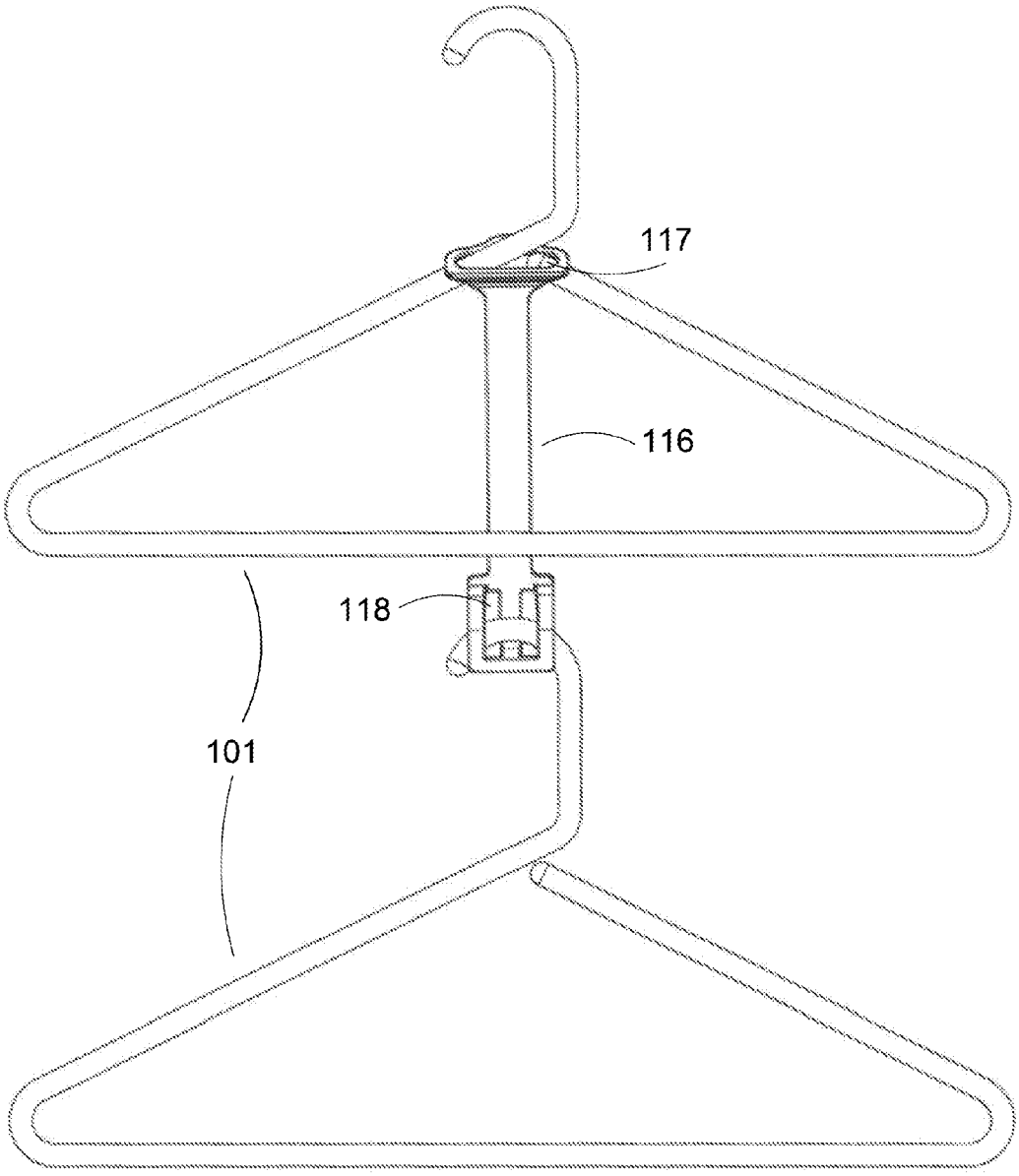
FIG. 8 depicts a front elevation view of FIG. 7.

FIG. 8 depicts a front elevation of FIG. 7. Of note is how first aperture 117 of hanger support strap 116 hangs from a first hanger 101, while a second hanger 101 is secured within second aperture 118. As noted above, this embodiment should not be construed in a limiting fashion, but only as a potential embodiment of how hanger support strap may be employed.

Figure 9:
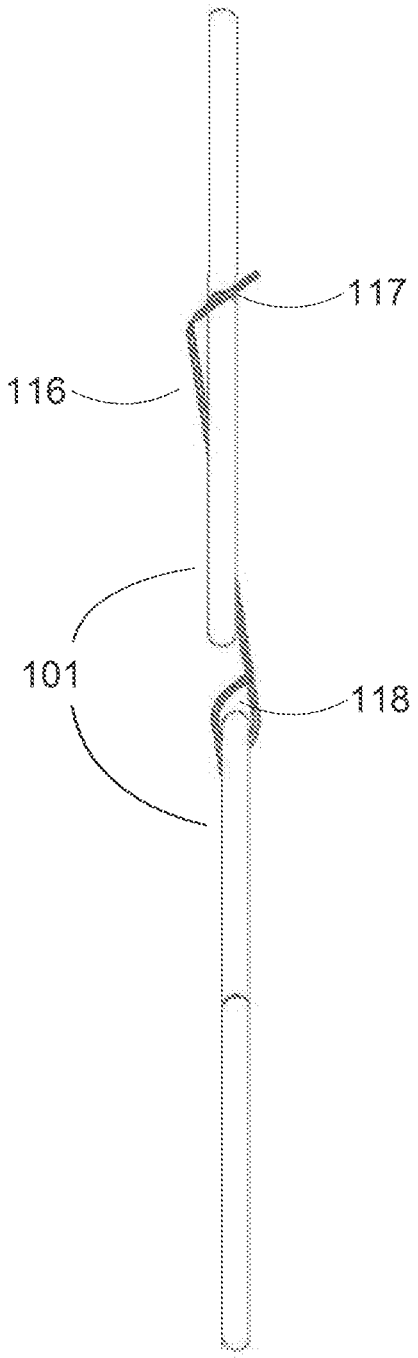
FIG. 9 depicts a side elevation view of FIGS. 7 and 8.

FIG. 9 depicts a side elevation of FIGS. 7 and 8. Two hangers 101 are connected to hanger support strap 116 utilizing both first and second apertures 117 and 118. It may be noted that this configuration may allow for one to double closet space. Again, this embodiment is not to be considered limiting in scope, but rather one possible embodiment of all that has been discussed thus far.

FIG. 10A is a front elevation view of hanger support strap 116. This embodiment shows in further detail how both first and second apertures 117 and 118 may be fluidly connected on opposite ends during the manufacturing process to hanger support strap 116. A series of grooves may be implemented near the base of the top of first aperture 117 to afford more flexibility to hanger support strap 116.

FIG. 10B is a side elevation view of hanger support strap 116. As noted above hanger support strap 116, and both first and second apertures 117 and 118 may be constructed of a similar materials as that of shoulder cover 106.

FIG. 10C is a three dimensional view depicting clip 1001 attached to shoulder cover fasteners 108 of shoulder covers 106. Once the requisite number of shoulder covers 106 has been appropriately attached to hanger 101, clip 1001 may be attached to the overlapping shoulder cover fasteners 108 to prevent loose ends from going awry. Clip 1001 may also be constructed of similar material as the rest of the components discussed thus far.

A hanger strap and shoulder covers have been described. The foregoing description of the various exemplary embodiments of the hanger strap and shoulder covers have been presented for the purposes of illustration and disclosure. It is not intended to be exhaustive or limiting to the precise form disclosed. Many modifications and variations are possible in light of the above teaching. It is intended that the scope of the hanger strap and shoulder covers not be limited by this detailed description.

What is claimed is:

1. A hanger accessory, comprising:

a first shoulder cover configured to extend longitudinally along an upper surface of a first shoulder rail of a hanger; and a second shoulder cover configured to extend longitudinally along an upper surface of a second shoulder rail of the hanger wherein the first and second shoulder covers are wider than the first and second shoulder rails of the hanger and extend beyond the surface area thereof, the shoulder covers comprising:

a fastener for attaching the shoulder cover to the shoulder rail of the hanger;

a top curved surface having a distal end and a proximate end;

a flexible fastener that is integral with the top curved surface and extends outwardly from the distal end of the top curved surface, the flexible fastener comprising:

a first plurality of openings arranged along the center of an interior portion of the flexible fastener; and a second plurality of openings arranged along the center of an exterior portion of the flexible fastener, each of the second plurality of openings for receiving a hook portion of the hanger.

2. The hanger accessory of claim 1, wherein the first and second plurality of openings form a linear array along the center of the flexible fastener.

3. The hanger accessory of claim 1, wherein the first plurality of openings arranged along the center of the interior portion of the flexible fastener comprise of arced openings.

4. The hanger accessory of claim 1 wherein the second plurality of openings arranged along the center of the exterior portion of the flexible fastener comprise of wide openings for receiving the hook portion of the hanger.

5. The hanger accessory of claim 1, wherein the fastener for attaching the shoulder cover to the shoulder rail of the hanger, comprises:

a clamp; and a clamp fastener configured to attach to the clamp.

6. The hanger accessory of claim 1, wherein the fastener of each of the shoulder covers further comprises a support member protruding through the top curved surface, and a clamping device configured to mate with the support member.

7. The hanger accessory of claim 6, wherein the support member protruding from the top curved surface of each shoulder covers is situated between the flexible fastener and the proximate ends of the top curved surface.

8. The hanger accessory of claim 1, wherein each shoulder cover comprises a channel situated beneath the top curved surface through which the shoulder rail of the hanger extends.

9. The hanger accessory of claim 1, further comprising a clip for holding the flexible fastener of the first and second shoulder covers together.

10. A hanger shoulder cover configured to extend longitudinally along an upper surface of a shoulder rail of a hanger, comprising:

a fastener for attaching the shoulder cover to the shoulder rail of the hanger;

a top curved surface having a distal end and a proximate end; and a flexible fastener that is attached to or integral with the top curved surface, and extends outwardly from the distal end of the top curved surface, the flexible fastener having an interior portion and an exterior portion, the flexible fastener comprising:

a first plurality of openings arranged along the center of the exterior portion of the flexible fastener, each of the first plurality of openings configured for receiving a hook portion of the hanger.

11. The hanger shoulder cover of claim 10, wherein the flexible fastener further includes a second plurality of openings arranged along the center of the interior portion of the flexible fastener.

12. The hanger shoulder cover of claim 11, wherein the first and second plurality of openings form a linear array along the center of the flexible fastener.

13. The hanger shoulder cover of claim 12, wherein the second plurality of openings arranged along the center of the interior portion of the flexible fastener comprise of arced openings.

14. The hanger shoulder cover of claim 13, wherein the first plurality of openings arranged along the center of the exterior portion of the flexible fastener comprise of wide oval openings.

15. The hanger shoulder cover of claim 14, wherein the fastener for attaching the shoulder cover to the shoulder rail of the hanger, comprises:

a clamp; and a clamp fastener configured to attach to the clamp.

16. The hanger shoulder cover of claim 15, further comprising a channel situated beneath the top curved surface through which the shoulder rail of the hanger extends.

* * * * *